United States Patent [19]

Jensik

[11] Patent Number: 5,066,246

[45] Date of Patent: Nov. 19, 1991

[54] MOUNTING BRACKET FOR AN ELECTRICAL CONNECTOR

[76] Inventor: James B. Jensik, 2337 Frey Ave., Venice, Calif. 90291

[21] Appl. No.: 618,736

[22] Filed: Nov. 27, 1990

[51] Int. Cl.[5] ..... H01R 13/621

[52] U.S. Cl. ..... 439/562; 439/361; 439/564; 29/842

[58] Field of Search ..... 248/27.1; 439/359, 361, 439/362, 562–567, 569, 570, 571, 681; 29/842

[56] References Cited

U.S. PATENT DOCUMENTS

| | | | |
|---|---|---|---|
| 3,675,183 | 7/1972 | Drake . | |
| 4,318,157 | 3/1982 | Rank et al. . | |
| 4,446,504 | 5/1984 | Jordan et al. . | |
| 4,634,203 | 1/1987 | Noyes | 439/359 X |
| 4,929,184 | 5/1990 | Emadi et al. . | |

FOREIGN PATENT DOCUMENTS 2498829 7/1982 France .

*Primary Examiner*—Eugene F. Desmond
*Attorney, Agent, or Firm*—Bacon & Thomas

[57] ABSTRACT

A bracket for an electrical connector is disclosed wherein the bracket has a body defining an opening to accommodate a portion of the electrical connector and to which is fixedly attached a plurality of stud members. The stud members each have a head portion extending from one side of the bracket body, the head portion defining an internally threaded hole to accept a mounting or a holddown screw to attach the electrical connector portion to the bracket. Each stud member also has a threaded stud portion extending from an opposite side of the bracket body. These studs may be attached to a panel or to another connector by placing nuts or the like over the threaded stud portions.

9 Claims, 4 Drawing Sheets

FIG. 1
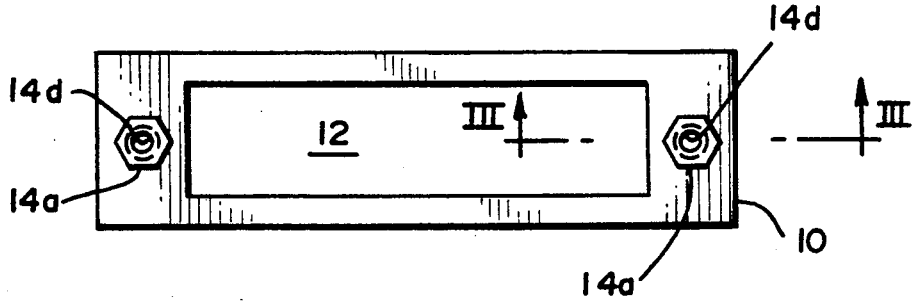
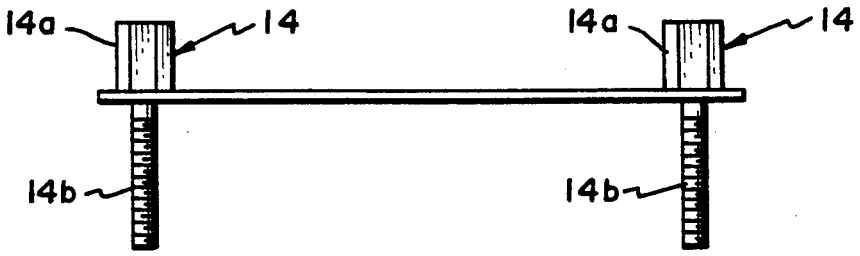
FIG. 2
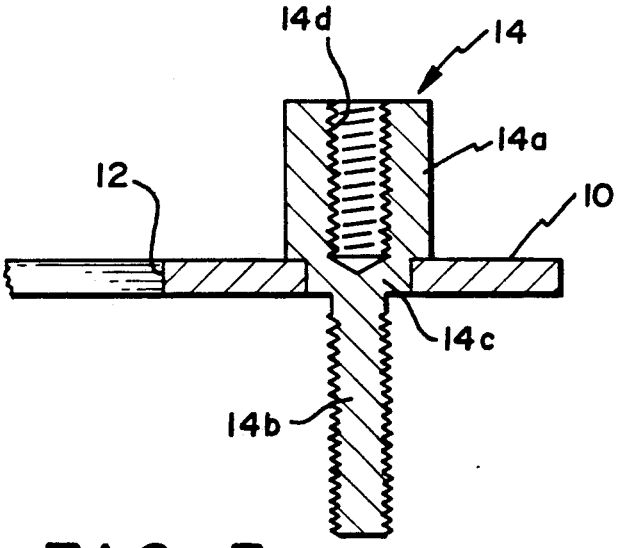
FIG. 3
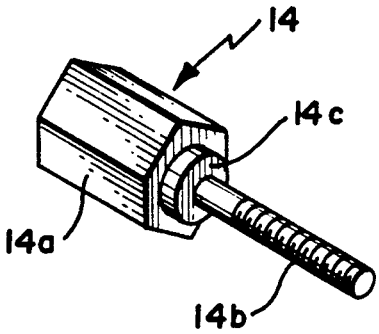
FIG. 4

MOUNTING BRACKET FOR AN ELECTRICAL CONNECTOR

BACKGROUND OF THE INVENTION

The present invention relates to a mounting bracket for mounting an electrical connector onto a panel or the like.

When using modern electrical devices it is often necessary to interconnect several of the devices and/or interconnect the internal components of one or more of these devices. The field of electrical connectors has proliferated in recent years, the development of such connectors resulting in a decrease in their size and an increase in their capacity.

While today's connectors are capable of carrying more connections than ever before, the miniaturization of today's electronic devices and, consequently, the electrical connectors, has made the attachment of such connectors to the devices more difficult. Such connectors typically comprise a male portion and a female portion and it is, quite obviously, necessary to mount one portion or the other to the electrical device, usually a wall panel or the like. The reduction in size of the electronic devices often necessitates the placement of the connector portions closely adjacent, or requires them to be located in inaccessible areas. Such locations render it extremely difficult to attach the connector portion to the panel and further renders the servicing of such connectors extremely difficult to carry out in a reasonable time.

Typically, the male or female connector portion is attached to the panel via studs extending through the panel and a portion of the connector. When the hold-down or mounting screws attaching the connector to the panel are tightened or loosened, the studs sometimes also turn. Excessive turning of the stud will cause the nuts and washers, which hold them on the panel, to come off and fall inside the electrical device, often causing catastrophic short circuiting.

Even if the nuts and washers do not completely fall off of the stud, or if self locking (aircraft type) nuts are used, if the stud turns it must be gripped with a pair of pliers while the hold-down screws are tightened or loosened. In areas in which the panel contains several such connectors, this is often not possible.

It is also known to retain the connector portions on a panel using wire clips that snap into a notch. While these alleviate some of the problems associated with hold down screws, they have not proven to be totally effective. The wire clips bend out of shape easily, often rendering them ineffective and inoperable. Heavy strain on the cable can uncouple the wire clips.

Some connectors are manufactured with a slide that is formed with keyhole shaped slots that engage special grooved studs. The connector is first engaged and the slide is slid laterally to engage the studs. The slides easily bend out of shape, thereby rendering it impossible to either insert or slide the connector.

On some electrical devices, the panel itself defines tapped holes to accept the retaining screws for the connector. This complicates the construction of the electrical device, since the panel must then be formed with a thickness sufficient to properly engage the hold-down screws. When one of the holes is stripped, not only is it impossible to install the connector portion, but the whole panel must then be replaced.

SUMMARY OF THE INVENTION

A bracket for attaching an electrical connector to a panel is disclosed wherein the bracket has a body defining an opening to accommodate a portion of the electrical connector and to which is fixedly attached a plurality of stud members. The stud members each have a head portion extending from one side of the bracket body, the head portion defining an internally threaded hole to accept a mounting or hold-down screw to attach the electrical connector portion to the bracket. Each stud member also has a threaded stud portion extending from an opposite side of the bracket body which extends through panel. The threaded stud portion also extends through a hole in the mounting flange of the mating connector portion, which may be installed on an opposite side of the panel, or between the panel and the bracket. The stud bracket, panel and mating connector are held together by placing nuts or the like over the threaded stud portions.

The opening defined by the bracket body may be either generally rectangular or generally trapezoidal in configuration. If rectangular, the opening will be long enough to accommodate a D-shaped connector in either of the two possible orientations. If trapezoidal, the opening may accept the D-shaped connector only in one orientation.

If desired, the bracket body can be formed with longitudinally extending flanges to increase the strength and rigidity of the bracket body.

Since the stud members are fixedly attached to the bracket body, such as by brazing, welding, etc., it is impossible for them to turn or rotate as the hold down screws for attaching the electrical connectors are inserted. Also, such feature renders the attachment of the bracket body to the panel easier, since it is no longer necessary to hold the stud members as the nuts and washers are applied to attach the bracket to the panel.

BRIEF DESCRIPTION OF THE DRAWINGS

FIG. 1 is a top, plan view of the bracket according to the present invention.

FIG. 2 is a side view of the bracket shown in FIG. 1.

FIG. 3 is an enlarged, partial, cross-sectional view taken along line III—III in FIG. 1.

FIG. 4 is a perspective view of the stud member according to the present invention.

DETAILED DESCRIPTION OF THE PREFERRED EMBODIMENTS

The bracket according to the present invention comprises a bracket body 10, which may have a generally rectangular configuration and which defines an opening 12. Opening 12 may either be generally rectangular in configuration, as illustrated in FIG. or may be generally trapezoidal, as illustrated at 24 in FIG. 6. The opening accommodates a portion of an electrical connector, which portion may be D-shaped, as is well-known in the art. If opening 12 is rectangular, it is dimensioned so as to accept the D-shaped portion of the electrical connector in either of two orientations, which are 180° apart.

A plurality of stud members 14 are fixedly attached to the bracket body 10 such as by welding, brazing, etc. It is to be understood that this invention is not limited to the precise method for fixedly attaching the stud members to the bracket body, but any known method may be utilized as long as the stud members are fixedly attached to the body such that they will not rotate with respect to the body.

Each stud member 14 comprises a head portion 14*a* which may have a generally circular or a generally hexagonal cross-sectional shape and which extends from one side of the bracket body 10, and a threaded stud portion 14*b* which extends outwardly from an opposite side of the bracket body 10. Stud portions 14*b* are externally threaded to accept known nuts or the like.

As illustrated in FIGS. 3 and 4, the stud members 14 may also define a generally cylindrical portion 14*c* located between the head portion 14*a* and the threaded stud portion 14*b*. The cylindrical portion 14*c* extends through an opening formed in the bracket body 10 as illustrated in FIG. 3. The length of the cylindrical portion 14*c* should be approximately equal to the thickness of the bracket body 10. It is also possible to use the stud member 14 without the cylindrical portion 14*c*, if desired, without exceeding the scope of this invention.

Head portions 14*a* of the stud members 14 define internally threaded blind holes 14*d*. The depth of hole 14*d* may, of course vary, and may extend downwardly into the cylindrical portion 14*c*, as illustrated. The depth of this hole should be sufficient to fully accommodate the mounting or hold-down screw attaching the electrical connector to the bracket.

Figure 5:
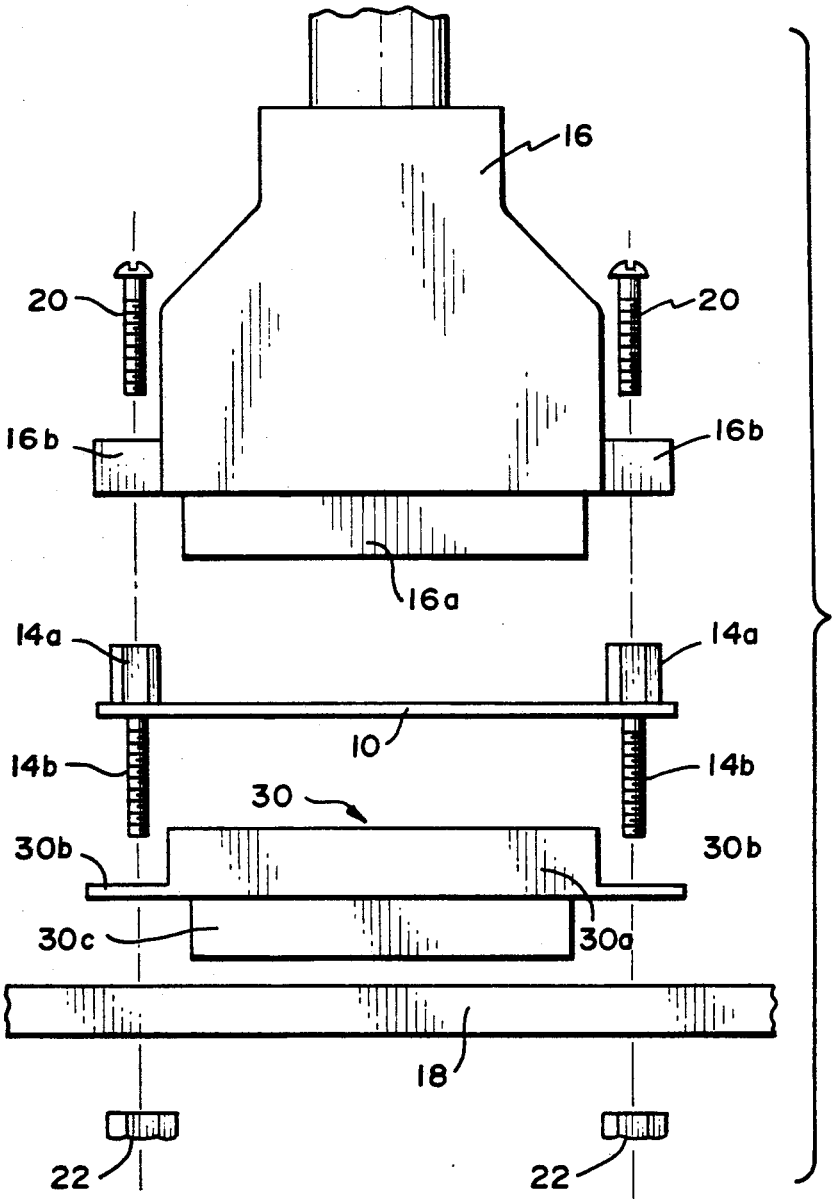
FIGS. 5 and 6 are exploded, side views illustrating the use of the bracket to attach an electrical connector to a panel.

FIG. 5 illustrates the use of the bracket for attaching an electrical connector portion 16 to a panel 18. As is well-known in the art, electrical connector portion 16 has a mating portion 16*a* which, in known fashion, mates with the other half of the electrical connector 30. This mating portion extends through the opening 12 defined in the bracket body 10. Mounting flanges 16*b* typically extend laterally from the connector 16 and define openings through which mounting or hold-down screws 20 extend. As is well known in the art, screws 20 may be "captive" on connector portion 16 enabling this assembly to be handled as a single unit.

Stud portions 14*b* extend through holes (not shown) formed in the connector portion 30 and panel 18 such that, once inserted, the bracket body 10 and the connector portion 30 may be fixedly attached to the panel 18 by threading nuts 22 onto stud portions 14*b*. As illustrated in FIG. 5, the connector portion 30 may be installed between the stud bracket 10 and the panel 18. Studs 14*b* extend through openings (not shown) in flanges 30*b* while mating portion 30*a* extends through opening 12. Portion 30*c* extends into and through an opening (not shown) in panel 18.

Figure 6:
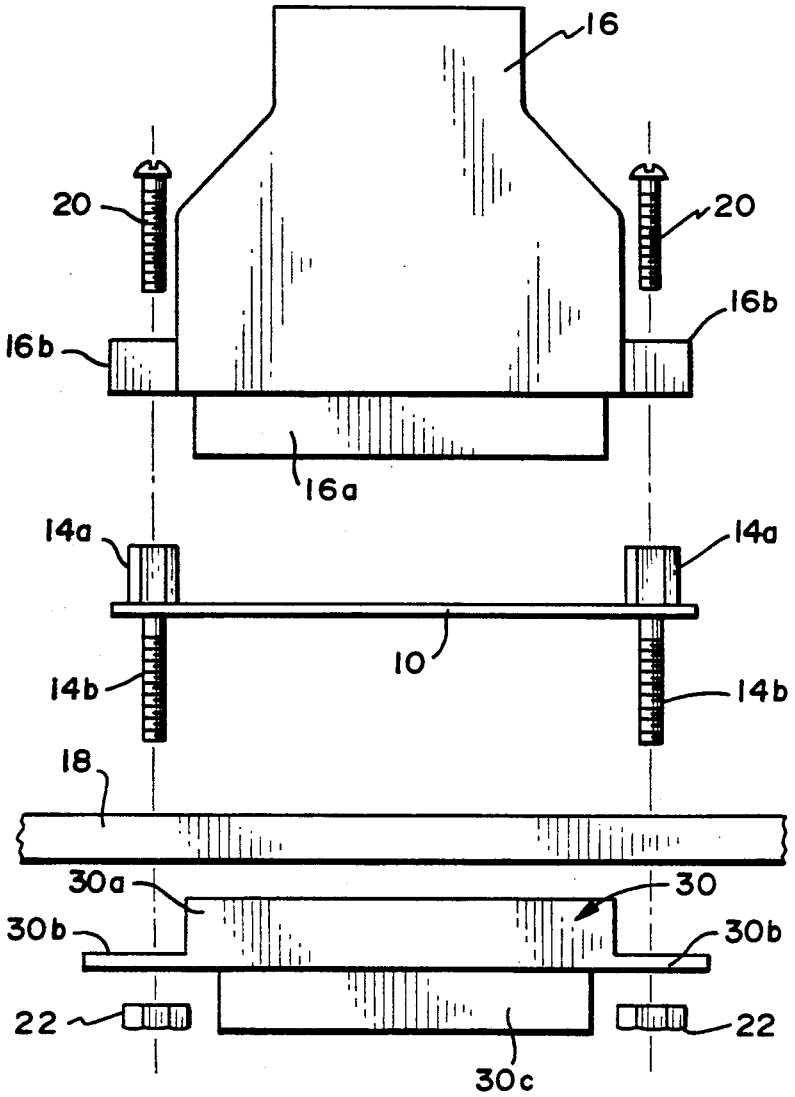

Alternatively, connector portion 30 may be installed on the opposite side of panel 18 from mounting bracket body 10, as illustrated in FIG. 6. In this instance, mating portion 30*a* extends through the opening (not shown) in panel 18. As in the previously described orientation, studs 14*b* extend through panel 18 and flanges 30*b* so that the elements may be assembled by threading nuts 22 onto the studs.

In both embodiments, the electrical connector 16 may be attached to the bracket by placing mounting screws 20 through the mounting flanges 16*b* and threading them into the holes 14*d* formed in the stud members 14. It should be noted that, since stud members 14 are fixedly attached to the bracket body 10, it is unnecessary to further restrain their movement during the attachment of nuts 22 or mounting screws 20. Depending upon the accessibility of the area in which the electrical connector is to be mounted, either the mounting bracket 10 may be first attached to the panel 18 and the electrical connector 16 subsequently attached to the bracket, or the bracket 10 may be first attached to the electrical connector 16 and this assembly subsequently attached to the panel 18.

Figure 7:
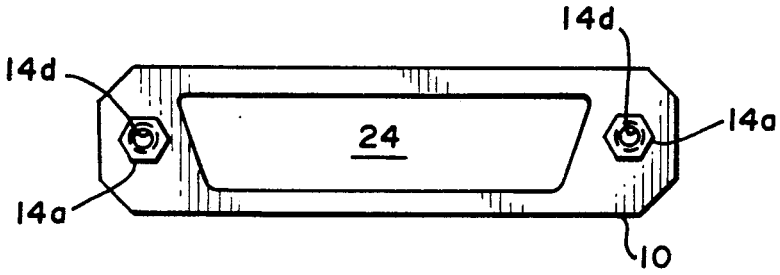
FIG. 7 is a top view of a second embodiment of the bracket according to the present invention.

FIG. 7 discloses an alternative embodiment of the bracket body 10. In this embodiment, the opening 24 defined by the bracket body 10 has a generally trapezoidal configuration so as to accommodate a known D-shaped connector portion. The structure and function of the stud members 14 are exactly the same as in the previously discussed embodiment.

Figure 8:
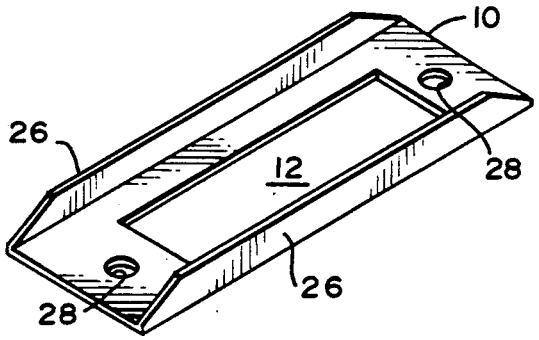
FIG. 8 is a perspective view of a third embodiment of the bracket according to the present invention.

FIG. 8 illustrates yet another embodiment of the bracket body 10. In this embodiment, the bracket body 10 has generally longitudinally extending flanges 26 extending from one side of the bracket body substantially along its entire length. FIG. 8 illustrates the bracket body 10 prior to the installation of the stud members 14, which are inserted through openings 28. Quite obviously, the flanges 26 may also be incorporated into the embodiment of the bracket shown in FIG. 7 without exceeding the scope of this invention.

It is frequently necessary to connect two cable ends together, each cable end having a connector portion. Traditionally, connector portions, each of which have mounting screws, have been attached by placing elongated nuts between the connector portions and threading the respective mounting screws into opposite ends of the nuts. However, the mounting screws frequently bottom out in the nuts before the connector portions have been connected.

Figure 9:
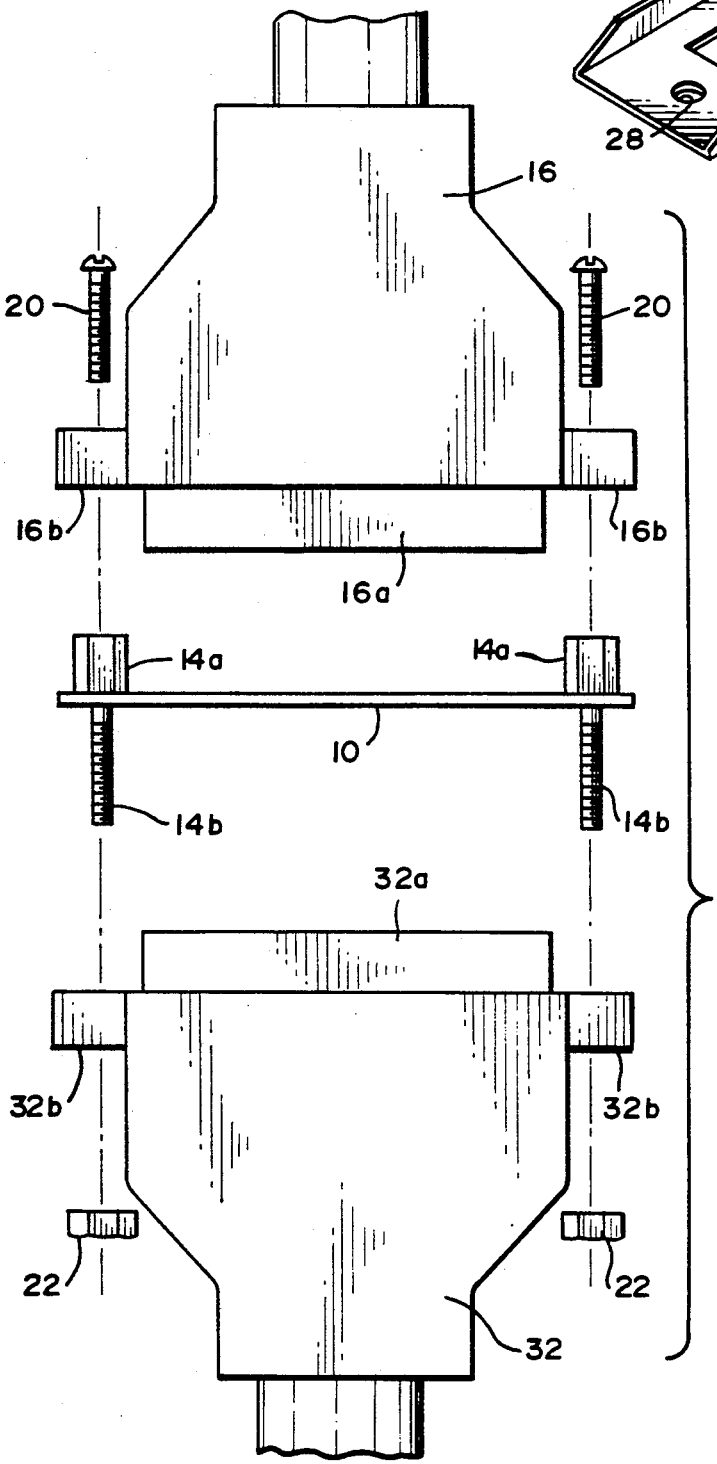
FIG. 9 is an exploded side view illustrating the use of the mounting bracket to connect two cable ends together.

The mounting bracket according to the present invention may be used to cure this problem. As illustrated in FIG. 9, the mounting bracket may be attached to connector portion 32 from which the screws have been removed, by inserting studs 14*b* through flanges 32*b* and threading nuts 22 onto the studs. Mating portion 32*a* will extend through opening 12. Connector portion 16 may then be attached as previously described.

The foregoing description is provided for illustrative purposes only, and should not be construed as in any way limiting this invention, the scope of which is defined solely by the appended claims.

I claim:

1. A mounting bracket for an electrical connector comprising:

(a) a bracket body defining an opening to accommodate at least a portion of the electrical connector; and, (b) a plurality of stud members non-removably and non-rotatably attached to the bracket body, each stud member comprising:

(i) a head portion extending from one side of the bracket body, the head portion defining an internally threaded hole to threadingly accept a mounting screw to attach the electrical connector to the bracket; and (ii) a threaded stud portion extending from an opposite side of the bracket body, the stud portion having external threads thereon.

2. The bracket according to claim 1 wherein the configuration of the opening is substantially rectangular.

3. The bracket according to claim 1 wherein the configuration of the opening is generally trapezoidal.

4. The bracket according to claim 1 further comprising at least one flange portion extending from and generally perpendicular to the bracket body.

5. The bracket according to claim 4 wherein the flange portion extends along substantially the entire length of the bracket body.

6. A method of attaching an electrical connector to a panel comprising the steps of:

(a) providing a mounting bracket comprising:

(i) a bracket body defining an opening to accommodate at least least a portion of the electrical connector; and, (ii) a plurality of stud member non-removably and non-rotatably attached to the bracket body, each stud member comprising:

(a) a head portion extending from one side of the bracket body, the head portion defining an internally threaded hole to threadingly accept a mounting screw to attach the electrical connector to the bracket;

(b) a threaded stud portion extending from an opposite side of the bracket body, the head portion defining an internally threaded hole to threadingly accept a mounting screw to attach the electrical connector to the bracket;

(b) attaching the mounting bracket to the panel by inserting the threaded stud portions through openings defined by the panel and placing nut members on the threaded stud members;

(c) placing the electrical connector in operative relationship with the mounting bracket; and, (d) attaching the electrical connector to the mounting bracket by threaded fasteners extending into the internally threaded holes in the head portion.

7. A method of attaching an electrical connector to a panel comprising the steps of:

(a) providing a mounting bracket comprising:

(i) a bracket body defining an opening to accommodate at least a portion of the electrical connector; and, (ii) a plurality of stud member non-removably and non-rotatably attached to the bracket body, each stud member comprising:

(a) a head portion extending from one side of the bracket body, the head portion defining an internally threaded hole to threadingly accept a mounting screw to attach the electrical connector to the bracket; and (b) a threaded stud portion extending from an opposite side of the bracket body, the stud portion having external threads and a length sufficient to pass through the panel so as to enable nuts threaded onto the stud portion to attach the bracket to the panel;

(b) placing the electrical connector in operative relationship with the mounting bracket;

(c) attaching the electrical connector to the mounting bracket by threaded fasteners extending into the internally threaded holes in the head portion;

(d) attaching the mounting bracket to the panel by inserting the threaded stud portions through openings defined by the panel and placing nut members on the threaded stud members.

8. A method of attaching first and second electrical connectors together comprising the steps of:

(a) providing a mounting bracket comprising:

(i) a bracket body defining an opening to accommodate at least a portion of the first electrical connector; and, (ii) a plurality of stud member non-removably and non-rotatably attached to the bracket body, each stud member comprising:

(a) a head portion extending from one side of the bracket body, the head portion defining an internally threaded hole to threadingly accept a mounting screw; and (b) a threaded stud portion extending from an opposite side of the bracket body, the stud portion having external threads;

(b) attaching the mounting bracket to the first connector by nut means threaded onto the stud portions;

(c) placing the first and second electrical connectors in mating relationship; and, (d) attaching the second electrical connector to the mounting bracket by threaded fasteners inserted into the head portions of the stud members.

9. An electrical connector assembly comprising:

(a) first and second electrical connectors;

(b) a mounting bracket operatively associated with the first and second electrical connectors comprising:

(i) a bracket body defining an opening to accommodate at least a portion of the first electrical connector; and, (ii) a plurality of stud members non-removably and non-rotatably attached to the bracket body, each stud member comprising:

(a) a head portion extending from one side of the bracket body, the head portion defining an internally threaded hole to threadingly accept a mounting screw; and (b) a threaded stud portion extending from an opposite side of the bracket body, the stud portion having external threads;

(c) first means to attach the threaded stud portions to the first electrical connector; and, (d) second means to attach the second electrical connector to the head portions of the stud members.

* * * * *